United States Patent [19]

Stepanenko et al.

[11] Patent Number: 4,770,016

[45] Date of Patent: Sep. 13, 1988

[54] METHOD OF WIRE STRAIGHTENING AND A WIRE STRAIGHTENING MACHINE FOR CARRYING OUT THE METHOD

[75] Inventors: Alexandr V. Stepanenko; Vladimir G. Voitov; Leonid S. Bezverkhy, all of Minsk, U.S.S.R.

[73] Assignee: Belorussky Politekhnichesky Institut, Minsk, U.S.S.R.

[21] Appl. No.: 930,549

[22] Filed: Nov. 12, 1986

[51] Int. Cl.[4] ..... B21D 3/12

[52] U.S. Cl. ..... 72/64; 72/371

[58] Field of Search ..... 140/147; 72/79, 88, 72/89, 95, 98, 64, 220, 371

[56] References Cited

U.S. PATENT DOCUMENTS

| | | | |
|---|---|---|---|
| 1,629,759 | 5/1927 | Wise | 72/89 |
| 2,279,347 | 4/1942 | Simons | 72/89 |
| 2,920,677 | 1/1960 | Anderson et al. | 72/79 |
| 3,331,231 | 7/1967 | Kaestner | 72/79 |
| 4,545,229 | 10/1985 | Stepanenko et al. | 72/88 |

FOREIGN PATENT DOCUMENTS

| | | | |
|---|---|---|---|
| 19512 | 7/1975 | Japan | 72/79 |
| 39435 | 3/1984 | Japan | 140/147 |
| 2129720 | 5/1984 | United Kingdom . | |

*Primary Examiner*—Lowell A. Larson

*Attorney, Agent, or Firm*—Lilling & Greenspan

[57] ABSTRACT

A wire straightening method involves feeding a wire from a reel to a wire twisting and stretching mechanism, where by wire straightening elements having working surfaces in each pair of such mechanisms arranged in opposition to each other, the wire is twisted in two opposite directions to plastic deformation of the material of the wire, and simultaneously stretched to within elastic deformation of the wire material. The wire is then received by a take up reel.

27 Claims, 7 Drawing Sheets

METHOD OF WIRE STRAIGHTENING AND A WIRE STRAIGHTENING MACHINE FOR CARRYING OUT THE METHOD

BACKGROUND OF THE INVENTION

1. Field of the Invention

This invention relates generally to the art of rolling and drawing, and more particularly to methods of straightening wire and machines for carrying out such methods.

The invention can find application in the production of metal cords, and flywire leads in electronic and electric-power engineering, as well as for making capillary tubes in microtechnology.

2. Description of the Prior Art

Advancements in wire straightening techniques and associated equipment has as the primary aim improvements in the physical and mechanical characteristics (such as strength and hardness), and geometrical parameters (such as roundness, linearity, and surface roughness) of the wire products.

There is known a method of straightening a wire (cf., British Pat. No. 2,129,720; Int. Cl. B 21 F 11/15, B 21 F 7/00, published May 23, 1984) involving twisting the wire in two opposite directions and stretching the wire. According to one feature of the method, the wire or rod is first twisted in the opposite directions, and then stretched.

There is also known a wire straightening device (cf., the same British Pat. No. 2,129,720) for carrying out the method as described in that patent and comprises a means for reeling out the wire, a means for twisting and stretching the wire, and a means for taking up the wire. In that device the means for twisting and stretching the wire includes a die through which the wire is threaded, a toothed rack, a gear ring engageable with the rack and embracing the die, and two clamps arranged at the opposite sides of the die.

However, according to that method and device, the wire straightening operation is carried out periodically, by preliminarily locking in place the portion of the wire being straightened, which increases the tendency of the wire to break, and affects the quality of wire straightening.

In addition, one more disadvantage of the above method and device for strengthening the wire resides in that the periodic straightening may cause, at various wire lengths, non-uniform tension of the wire and result in poor quality of the straightened wire.

One more disadvantage of the above prior art method and device resides in build-up of torsional strain of the material of the wire as it is being twisted, resulting in formation of loops tending to break inadvertently and again affecting the quality of wire straightening.

SUMMARY OF THE INVENTION

It is therefore an object of the present invention to provide method and device capable of improving the quality of wire straightening.

Another object is to provide a device and machine for wire straightening of a wider range of production capabilities.

One more object is to reduce the tendency of the wire to break during straightening.

The objects of the invention are attained by a method of wire straightening involving twisting the wire in two opposite directions and stretching the wire. Accoridng to the invention, twisting of the wire is carried out to plastic deformation of the material of the wire, whereas stretching of the wire proceeds to within elastic deformation of the material of the wire.

Desirably, twisting and stretching of the wire is accompanied by bending the wire to attain plastic deformation of the material of the wire at a surface thereof with a greater bend radius.

Preferably, the wire is bent in two opposite directions.

Advisably, the wire is bent on a bend radius equal in magnitude in both directions.

Favourably, the wire is bent to bend angles equal in magnitude in both directions.

The objects of the invention are also attained by a wire straightening machine for carrying out the method comprising a means for reeling out the wire, means for twisting and stretching the wire, and means for reeling on the wire, all arranged in the path of travel of the wire. According to the invention, the means for twisting and stretching the wire includes, arranged successively in the path of travel of the wire and accommodated in housings, two pairs of wire straightening elements disposed in opposition to each other, and two reciprocating mechanisms mechanically connected to the corresponding pair of the wire straightening elements.

Advisably, the wire straightening elements in each pair of such elements of the wire twisting and stretching means are arranged in parallel to one another.

Desirably, the working surfaces of the wire straightening elements disposed at both sides of the wire being straightened are arranged in different geometrical planes.

Preferably, each wire straightening element of the means for twisting and stretching the wire has the form of a die.

Favourably, a curvilinear groove is provided at the working surface of each die to extend along the center line of the die.

Alternatively, in the wire twisting and stretching means, each reciprocating mechanism comprises a cam each end face of which has a groove, two slot links each of which is arranged above the corresponding end face of the cam, and two pins, each extending through the corresponding slot link and occupying the corresponding groove of the cam.

Desirably, each wire straightening element of the wire twisting and stetching means has the form of a roll capable of rotating about its longitudinal axis in the path of travel of the wire, the machine additionally comprising a rotating mechanism mechanically connected to the rolls.

Advisably, the rolls in each pair of rolls are kinematically interconnected with a transmission ratio of 1:1 in the pair and with a transmission ratio of 1:(1.0–1.4) between the pairs.

Preferably, the rolls in each pair of rolls are kinematically interconnected by a gear assembly or unit mechanically connected to the rotating mechanism.

The present invention makes it possible to rectify certain cross-sectional irregularities of the wire (such as cut, out-of-roundness, non-linearity, etc), which results in improved quality of wire straightening.

The invention also ensures self-feeding of the wire during wire straightening, which also improves the quality of the end wire product.

The invention further allows to straighten wires of required length.

The invention finally makes it possible to straighten wires of a range of diameters by the same wire straightening machine, thus expanding the machine production capabilities.

One more advantage of the invention is that it allows to reduce tensile stresses in the wire being straightened, thus making the wire less susceptible to breaking.

BRIEF DESCRIPTION OF THE DRAWINGS

The invention will now be described in greater detail with reference to various specific embodiments thereof taken in conjunction with the accompanying drawings, in which.

DESCRIPTION OF THE PREFERRED EMBODIMENTS

The proposed method of wire straightening resides in that the wire is twisted in two opposite directions, and simultaneously stretched. Twisting of the wire is carried out to plastic deformation of the material of the wire, whereas stretching proceeds to within elastic deformation of the material of the wire.

In order to ensure unform deformation across the wire, twisting and stretching is accompanied by bending of the wire in both directions to attain plastic deformation of the material of the wire at the surface of a greater bend radius.

For attaining a uniformly stressed state of the material of the wire, the wire is bent on bend radii equal in both directions.

For the same purpose the wire is bent about bend angles equal in magnitude in both directions.

Figure 1:
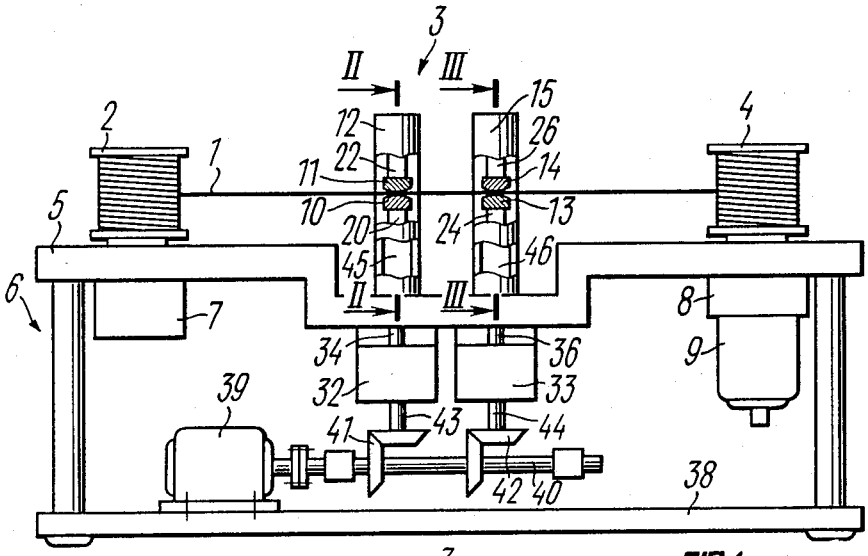
FIG. 1 is a general side elevational view of a wire straightening machine for carrying out the method according to the invention.
Figure 3:
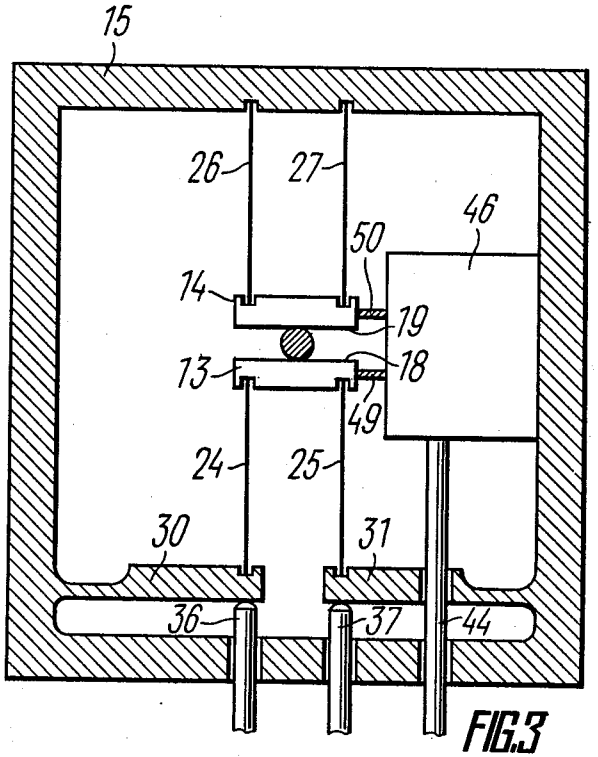
FIG. 3 is a section taken along the line III—III in FIG. 1.

With reference to FIG. 1, the wire straightening machine for carrying out the proposed method comprises a means 2 for reeling out the wire (hereinafter referred to as reel 2), means 3 for twisting and stretching the wire, and means 4 for reeling on the wire (hereinafter referred to as reel 4) mounted on the outer surface of a panel 5 of a frame 6. The reels 2 and 4 are capable of rotation. Arranged at the underside of the panel 5 under the reels 2 and 4 are electromagnetic powder clutches 7 and 8, respectively. An electric drive 9 is linked mechanically to the clutches 7 and 8. The means for twisting and stretching the wire comprises two pairs of wire straightening elements arranged in succession along the path of travel of the wire 1, each element in the pair of having the form of dies 10 and 11 inside a housing 12, and dies 13 and 14 inside a housing 15. Working surfaces 16 and 17 (FIG. 2) of the dies 10 and 11, respectively, and working surfaces 18 and 19 (FIG. 3) of the dies 13 and 14, respectively, are disposed opposite each other in parallel with each other. Attached to each die 10, 11, 13, 14 (FIGS. 1, 2 and 3) in pairs are substantially flat spring elements 20, 21 and 22, 23 (FIGS. 1 and 2), 24, 25 and 26, 27 (FIGS. 1 and 3). Other ends of the springs 22, 23 (FIG. 2) and 26, 27 (FIG. 3) are secured to the housings 12 (FIG. 2) and 15 (FIG. 3), whereas the other ends of the springs 20, 21 (FIG. 2) and 24, 25 (FIG. 3) are secured, respectively, to resilient cantilevers 28, 29 (FIG. 2) attached to the housing 12, and to resilient cantilevers 30, 31 (FIG. 3) attached to the housing 15. Mounted to the underside of the panel 5 (FIG. 1) under the housings 12 and 15 are mechanisms 32 and 33 of vertical displacement connected mechanically by means of pressure pins 34, 35 (FIG. 2) and 36, 37 (FIG. 3) to the respective cantilevers 28, 29 (FIG. 2) and 30, 31 (FIG. 3). A drive 39 is mounted on a base 38 of the frame 6, a shaft 40 of this drive 39 being mechanically linked by means of gear transmissions 41, 42 with corresponding shafts 43

(FIGS. 1 and 2) and 44 (FIGS. 1 and 3). Mechanically connected to the shaft 43 (FIGS. 1 and 2) is a mechanism 45 for executing reciprocations arranged inside the housing 12, whereas connected to the shaft 44 (FIGS. 1 and 3) is a similar reciprocating mechanism 46 arranged inside the housing 15. The mechanism 45 (FIG. 2) is mechanically linked with the dies 11 and 10 by rods 48 and 47, respectively, whereas the mechanism 46 (FIG. 3) is linked with the dies 13, 14 by rods 49 and 50, respectively.

Figure 5:
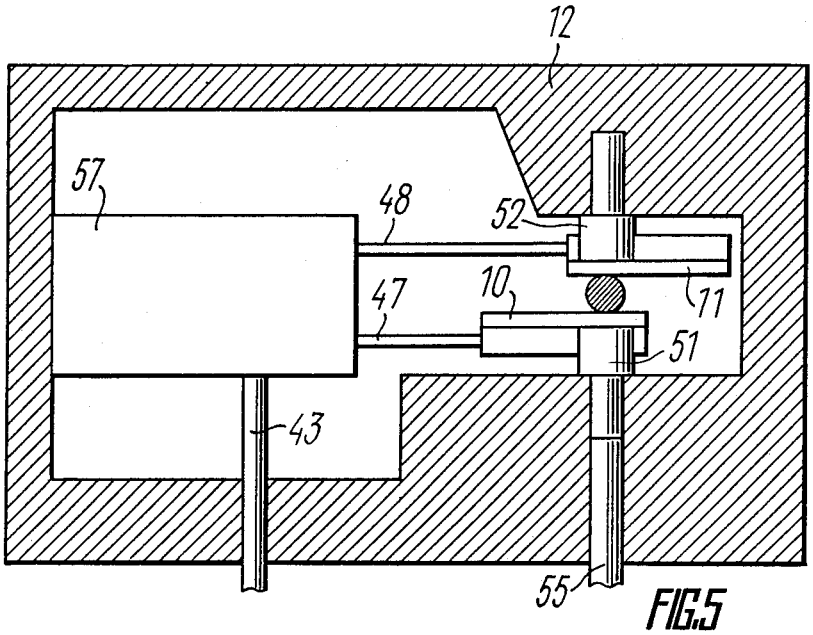
FIG. 5 is a section taken along the line V—V in FIG. 4.
Figure 6:
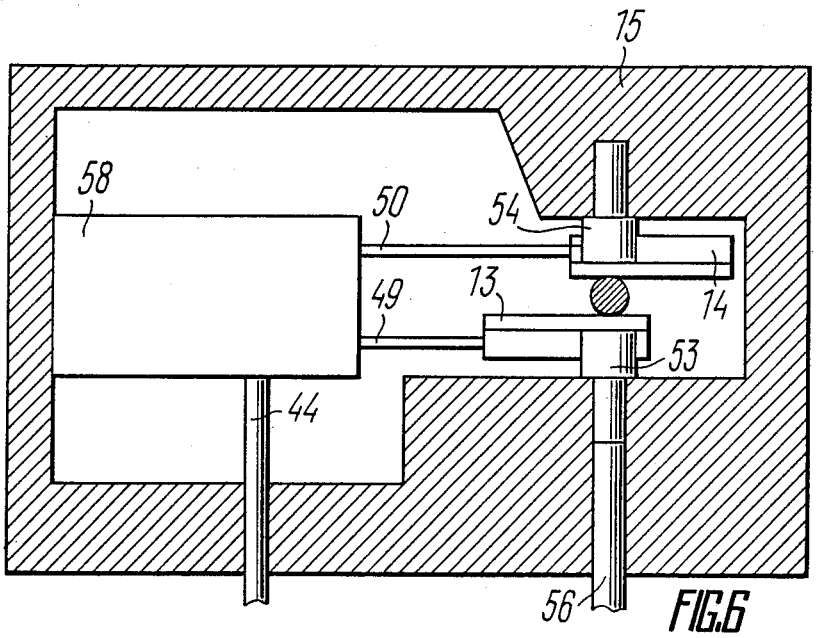
FIG. 6 is a section taken along the line VI—VI in FIG. 4.
Figure 7:
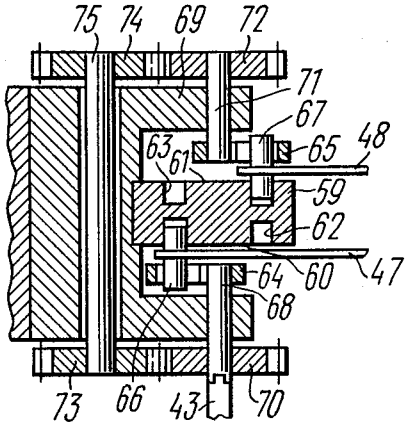
FIG. 7 is a longitudinal sectional view of the reciprocating mechanism.

According to another modified form of the wire straightening machine according to the invention for carrying out the proposed method, the means 3 comprises shafts 51, 52 (FIGS. 4 and 5) and 53, 54 (FIGS. 4 and 6), the die 10, 11 (FIGS. 4 and 5) and 13, 14 (FIGS. 4 and 6) being movably connected to one end of each of these shafts. The other end of each of the shafts 52 (FIG. 5) and 54 (FIG. 6) is rotatably attached to the housing 12 (FIG. 5) and 15 (FIG. 6), respectively, whereas the other end of each of the shafts 51 (FIG. 5) and 53 (FIG. 6) is mechanically connected by pressure pins 55 (FIGS. 4 and 5) and 56 (FIG. 4 and 6) to the respective mechanisms 32, 33. Provided inside the housing 12 (FIG. 5) is a reciprocating mechanism 57 linked kinematically with the rods 47, 48 and with the shaft 43, whereas the interior of the housing 15 (FIG. 6) accommodates a reciprocating mechanism 58 kinematically linked with the rods 49, 50 and with the shaft 44. Each reciprocating mechanism 57, 58 (FIGS. 5, 6) includes a cam 59 (FIG. 7) end faces 60 and 61 which are provided with grooves 62 and 63, respectively. At the end faces 60, 61 of the cam 59 there are disposed slot links 64, 65 through which extend pins 66, 67 mechanically connected by the respective rods 47, 48 to the dies 10, 11, respectively (FIG. 5). Similarly, the pins 66, 67 (FIG. 7) of the mechanism 58 (FIG. 6) are connected by the rods 49, 50 (not shown) to the dies 13, 14 (FIG. 6). A gear 70 is secured on a shaft 68 extending through the slot link 64 and a bracket 69 and mechanically connected to the shaft 43, whereas a gear 72 is secured on a shaft 71 extending through the slot link 65 and the bracket 69. The gears 70 and 72 are engageable with each other by means of gears 73 and 74 fixedly secured on a shaft 75 extending through the bracket 69. In a likewise manner, the shaft 68 of the mechanism 58 (FIG. 6) is mechanically connected to the shaft 44 (not shown).

Figure 8:
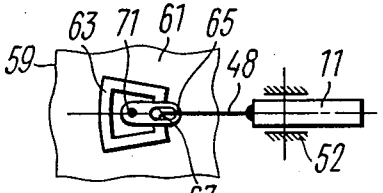
FIG. 8 shows a kinematic diagram of the initial mutual position of the die of the means for twisting and stretching the wire, and a pin of the reciprocating mechanism illustrated in FIG. 7.

Referring to FIG. 8, there is shown a mechanical diagram of the initial mutual position of the die 11 of the means 3 (FIG. 4) for twisting and stretching the wire, and pin 67 (FIG. 8) of the mechanism 57 (FIG. 5) or 58 (FIG. 6).

Figure 4:
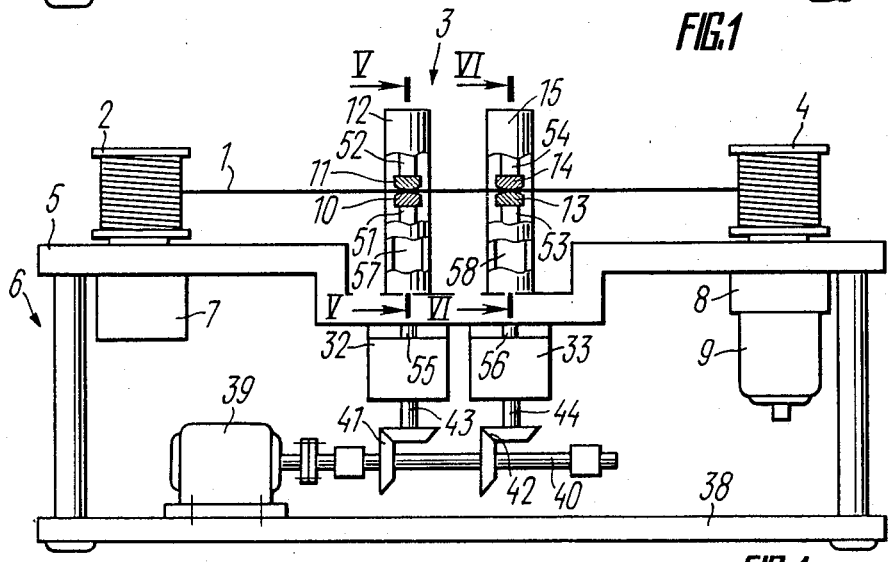
FIG. 4 is a general side elevational view of the wire straightening machine shown in FIG. 1 in the case, when the dies of the means for twisting and stretching the wire are connected to the housing by shafts.
Figure 9:
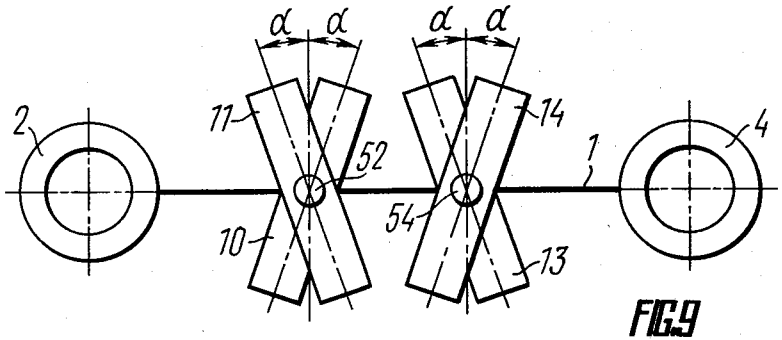
FIG. 9 is a kinematic diagram of the wire straightening machine shown in FIG. 4.

FIG. 9 illustrates a mechanical diagram of the proposed wire straightening machine as shown in FIG. 4 at the point, when the dies 10, 11, 13 and 14 deviate from their initial position at an angle $\alpha$.

Figure 11:
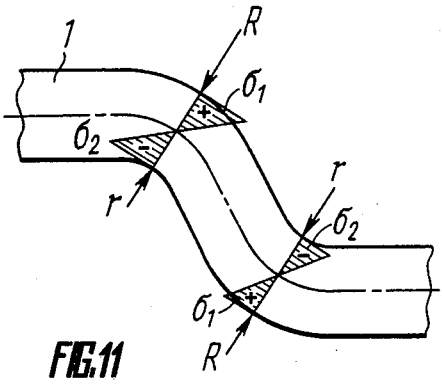
FIG. 11 are diagrams of the bending stresses of the material of the wire in the wire straightening machine with reference to FIG. 10.
Figure 12:
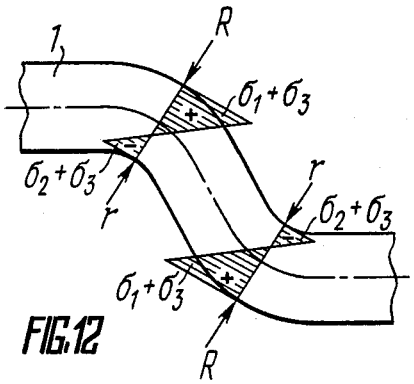
FIG. 12 are diagrams of the total bending and tensile stresses in the material of the wire of the wire straightening machine with reference to FIG. 10 in the case, when bending radii of the wire are equal in magnitude in both directions.
Figure 13:
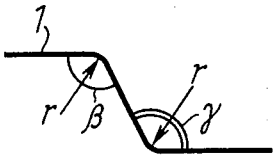
FIG. 13 is a schematic illustration of a bent wire in the wire straightening machine with reference to FIG. 10 with bend angles equal in both directions.

According to one more modification of the wire straightening machine for carrying out the method according to the invention, the dies 10 and 13 (FIG. 10) at one side of the wire 1, and dies 11 and 14 at the other side of the wire 1 lie in different, although parallel, geometrical planes. Bend radii r and R (FIGS. 11 and 12) of the wire 1 between the dies 10, 11 and 13, 14 are equal in magnitude in both directions. Bend angles $\beta$ and $\gamma$ (FIG. 13) of the wire 1 between the dies 10, 11 and 13, 14 (FIG. 10) are also equal in magnitude in both directions. Otherwise, this construction is similar to the one represented in FIG. 1.

Figure 14:
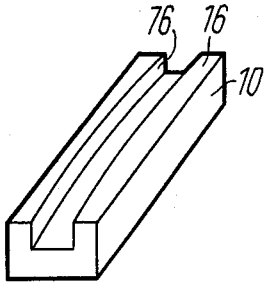
FIG. 14 is an axonometric view of a die with reference to FIG. 1 having a curvilinear groove.

According to yet another modification of the proposed wire straightening machine for carrying out the method according to the invention, the working surface 16, 17 (FIG. 2) and 18, 19 (FIG. 3) of each die (FIGS. 1, 4 and 10) has a curvilinear groove 76 (shown in FIG. 14 with reference to the die 10 at its working surface 16).

Figure 15:
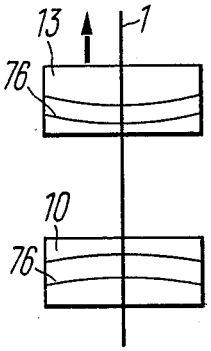
FIG. 15 is a schematic representation of the mutual positioning of the dies in a pair of dies of the wire twisting and stretching means of the machine shown in FIG. 14 in the case, when convex sides of their curvilinear grooves face each other.

FIG. 15 illustrates schematically the position of the dies 10 and 13 (FIGS. 1, 4, 10, 14) in the case, when the convex sides of their curvilinear grooves face each other.

A similar positioning of the dies 11 and 14 (FIGS. 1, 4, 10, 14) having the curvilinear groove 76 (FIG. 15) is not shown.

Figure 16:
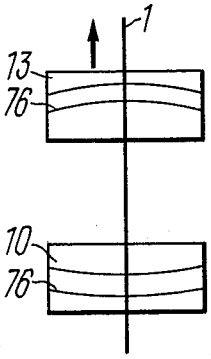
FIG. 16 is a schematic representation of the mutual positioning of the dies in a pair of dies of the wire twisting and stretching means of the machine shown in FIG. 14 in the case, when concave sides of their curvilinear grooves face each other.

FIG. 16 illustrates alternative positioning of the dies 10 and 13 (FIGS. 1, 4, 10, 14), when the concave sides of their curvilinear grooves face each other.

A similar positioning of the dies 10, 13 (FIGS. 1, 4, 10, 14) with the curvilinear groove 76 (FIG. 16) is not shown.

According to the last embodiment of the wire straightening machine for carrying out the proposed method, the means 3 for twisting and stretching the wire has straightening elements in the form of rolls 77, 78 (FIG. 17) inside the housing 12, and rolls 79, 80 inside the housing 15. The means 3 additionally comprises a rotation mechanism 81 (FIGS. 17, 18) shafts 82, 83 of which are mechanically connected to gear units 84, 85. The gear unit 84 comprises a gear 86 secured on the shaft 82 and engageable with a gear 87. The gear 87 and a gear 88 are secured on a shaft 89 mechanically connected to one of the ends of the roll 78. Engageable with the gear 88 is a gear 90 secured on a shaft 91 and mechanically connected to one of the ends of the roll 77. Other ends of the rolls 77, 78 are connected through shafts 92, 93 and rods 47, 48 to the reciprocating mechanism 45. In a likewise manner, the gear unit 85 comprises a gear 94 secured on the shaft 83 and engageable with the gear 95. The gear 95, and the gear 96 are secured on the shaft 97 connected to one of the ends of the roll 80. Adapted for engagement with the gear 96 is a gear 98 secured on a shaft 99 connected mechanically to one of the ends of the roll 79. Other ends of the rolls 79, 80 are connected by shafts 100, 101 and rods 49, 50 to the reciprocating mechanisms 46. In other respects, the construction of the machine is similar to the machine illustrated in FIG. 1.

The wire straightening machine with reference to FIGS. 1, 2 and 3 operates in the following manner.

The wire fed from the reel 2 is threaded through the clearance between the dies 10, 11 and through the clearance between the dies 13, 14. Then the electromagnetic powder clutches 7, 8 are engaged, and the electric drive 9 is energized to rotate the reel 4 for the wire to be pulled through the means 3 for twisting and stretching the wire 1. By virtue of a difference in the take up force at the reel 4 set by the torque produced by the clutch 8 and the force required for paying out the wire from the reel 2 set by the torque produced by the clutch 7, conditions are provided for pre-stretching the wire 1 within the limits of elastic deformation of its material. At the same time, the vertical displacement mechanisms 32, 33 and reciprocating mechanisms 45, 46 are actuated. The mechanisms 32, 33 impart axial movement to the pressure pins 34, 35 and 36, 37, which act to exert pressure on the resilient cantilevers 28, 29 and 30, 31, respectively. The resilient cavtilevers 28, 29, 30, 31 are displaced upwards from their initial position to move vertically the dies 10, 13 and bring them closer to the dies 11, 14 to a clearance between the dies 10 and 11, 13 and 14 equal to the diameter of the wire 1. The mechanisms 45, 46 act by the rods 47, 48 and 49, 50 to impart reciprocations to the dies 10, 11 and 13, 14 in the antiphase between the dies 10 and 11, 13 and 14, and in the antiphase between the pairs of dies 10, 11 and 13, 14. As a result, friction forces are induced between the working surfaces 16, 17 of the dies 10, 11, and working surfaces 18, 19 of the dies 13, 14 and the wire 1 to roll the wire 1 between the dies 10, 11, 13, 14 thereby providing favourable conditions for twisting upon attaining plastic deformation of the material of the wire 1 as it travels from the reel 2, passes through the housing 12, housing 15, and is taken up by the reel 4.

The mechanisms 45 and 46 are engaged by energizing the drive 39, which moves the shaft 40, gears 41, 42, and shafts 43, 44.

Therefore, as a result of the travel of the wire 1, it is straightened in the dies 10, 11 and 13, 14 because the wire 1 is stretched at its length between the housings 12 and 15 and is twisted by the torque produced by oppositely directed rolling of the wire 1 between the dies 10, 11 and 13, 14. The dies 10, 13 at one side of the wire 1, and the dies 11, 14 at the other side of the wire 1 also move in the opposite directions. In the case, when the dies 10, 13 and 11, 14 move in the same direction, the amplitude of reciprocations they execute should preferably be different in order to twist the wire 1 with the resulting amplitude sufficient for providing a minimum torque ensuring that the material of the wire 1 is subjected to plastic deformation. A change in the direction of twisting in time (i.e., the appearance of tangential stress in the material of the wire 1) is ensured in the proposed machine by varying the direction of reciprocations of the dies 10, 11, 13, 14. Variations in the amplitude of reciprocating motions of the dies 10, 11, 13, 14 produced by the mechanisms 45, 46 result in a different twisting angle of the length of the wire 1 between the housings 12 and 15.

Figure 2:
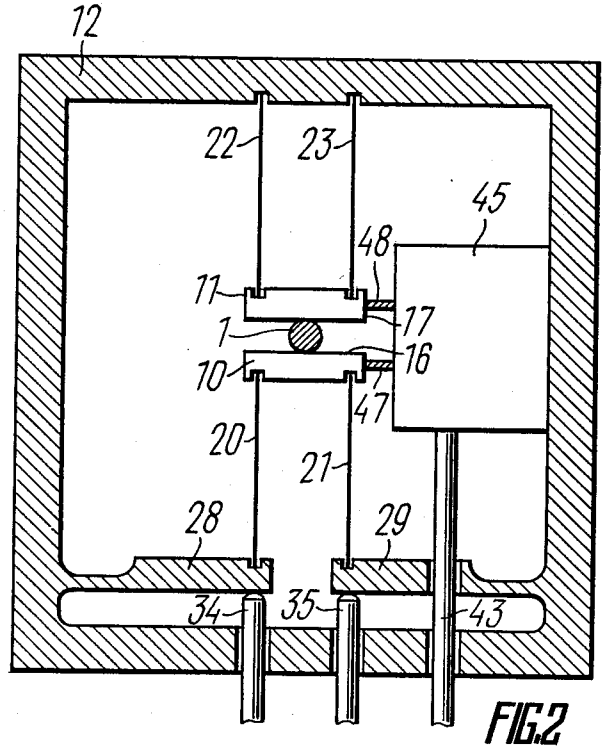
FIG. 2 is a section taken along the line II—II in FIG. 1.

The wire straightening machine with reference to FIGS. 4, 5, 6, 7, 8 and 9 operates generally as the aforedescribed shown in FIGS. 1, 2 and 3, except that along with the reciprocations, the dies 10, 11, 13, 14 execute simultaneous osccillations about the shafts 51, 52, 53, 54, respectively.

The shafts 43, 44 engage the reciprocating mechanisms 57, 58 for the shaft 68 to transmit rotation to the slot link 64, and through the gear assemblies 70, 73, 74, 72 and shaft 71 to the slot link 65. The slot links 64, 65, while rotating on the shafts 68, 71, act to translate the pins 66, 67 along the grooves 62, 63 of the cam 59, whereby the pins 66, 67 execute an orbital motion about the shafts 68, 71, which motion is transformed through the rods 47, 48 and 49, 50 by respective dies 10, 11 and 13, 14 into reciprocating and rotational movement relative to the shafts 51, 52 and 53, 54. Amplitude and frequency of reciprocations of the dies 10, 11, 13, 14 can be changed by altering the geometry of the grooves 62, 63 on the cam 59.

The phases of reciprocating motions and axial oscillations of the dies 10, 11, 13, 14, as well as deviations of these dies to the angle $\alpha$ relative to the initial position are determined by the law of their movement as represented with reference to the die 11 in FIGS. 19, 20, 21 and 22.

By virture of reciprocating motions and oscillations of the dies 10, 11, 13, 14 to the angle $\alpha$ relative to the centerline of the wire 1, this wire 1 is twisted and additionally self-fed along the path of travel by a component friction force directed substantially axially of the path of travel of the wire 1. In view of the aforedescribed, at the portion of the wire length between the housing 15 and take up reel 4 tensile stresses in the material of the wire 1 are reduced thanks to obviating the need for applying much force for pulling the wire 1 through the dies 10, 11, 13, 14; also diminished is the effect of vibration of the reel 4 on the tendency of the wire 1 to break in the course of straightening.

The wire straightening machine with reference to FIGS. 10, 11, 12 and 13 operates generally in the same manner as one shown in FIGS. 1, 2 and 3, although twisting and stretching is accompanied by bending the wire 1 in two directions until the material of the wire 1 is subjected to plastic deformation at the surface of the greater bend radius R.

According to the mutual positioning of the dies 10 and 13 at one side of the wire 1, and dies 11 and 14 at the other side of the wire 1 prior to straightening, the wire 1 is bent to one side as it exits the dies 10, 11, and to the opposite side as it enters the dies 13, 14. The machine is then actuated, and the wire 1 is straightened in substantially aforedescribed manner. Straightening the wire 1 of 100 to 50 mkm in diameter, or a wire of smaller diameter, fails to cause plastic deformation of its surface. When being bent, the outer surface of the wire 1 is subjected to a tensile stress $\sigma_1$ (cf., $\sigma_1$ stress diagram in FIG. 11), whereas the inner surface of the wire 1 is subjected to a compressive stress $\sigma_2$ (cf., $\sigma_2$ stress diagram in FIG. 11).

For attaining plastic deformation of the outer surface of wire 1 of the large radius R of bending, the bend radius R should be substantially the same as the diameter of the wire, which is difficult to materialize in practice; and therefore a wire of 100 mkm in diameter, or a wire of smaller diameter, is not amendable to straightening by bending only once, since such one bend fails to cause plastic deformation of the material of the wire 1. Therefore, the wire 1 is straightened by summing bend ($\sigma_1$ or $\sigma_2$) with tension (cf., diagram of $\sigma_3$ tensile stress in FIG. 12), whereby a substantial increase in plastic deformation is attained at the outer surface of the wire of the radius R characterized by the total stress $\sigma_1+\sigma_3$ (FIG. 12), which is greater than the stress $\sigma_2+\sigma_3$ (FIG. 12) at the surface of the wire 1 of the radius r. The bend radii R and r at the outer and inner surfaces, respectively, of the wire 1 are made equal during wire straightening, since at different bend radii R and r the magnitude of stresses $\sigma_1$ or $\sigma_2$ will be different to result in residual wire curvature subsequent to bending, that is in poor quality of the wire product. The bend angles $\beta$ and $\gamma$ (FIG. 13) are also specified equal in magnitude, since even at the equal bend radii R and r, but different angles $\beta$ and $\gamma$ the degree of flexural strain of the wire material will be different, and after passing the wire 1 through the straightening means it will retain a residual curvature, thereby rendering the end product spoiled. The equality of the bend angles $\beta$ and $\gamma$ of the wire 1 is attained by that the dies 10 and 13, 11 and 14 (FIG. 10) operate in the course of wire straightening in different parallel planes.

The wire straightening machine with reference to FIGS. 14, 15 and 16 operates in the following manner.

In the frictional contact of the wire 1 with the working surface 16, 17, 18, 19 of the dies 10, 11, 13, 14, respectively, the wire 1 is rolled by interaction with the curvilinear groove 76. The arcuate sides of the groove act at an angle to the surface of the wire 1 as the dies 10, 11, 13, 14 reciprocate to result in an extra component of the friction force in the area of contact of the wire 1 with the die 10 (11, 13, 14) directed toward the convexity of the groove 76.

When straightening the wire 1 by the proposed machine with the grooves 76 (FIG. 15) of the dies 10, 11, 13, 14 facing each other by their convexities, the resultant friction forces ensure added self-feed toward each other of the portions of the wire 1 in the area, where it is vigorously stretched between the pairs of dies 10 and 11, 13 and 14, which results in less intensive growth of tensile stresses. This wire straightening arrangement is preferable for materials of low ductility (such as W and V) tending to break, when sudden tensile stresses are exerted thereon.

Conversely, when straightening the wire 1 by the modified form of the machine, in which the grooves 76 (FIG. 16) face each other by their concavities, the wire 1 is self-fed in the area between the dies 10, 11, 13, 14 toward the convexities of the grooves 76.

Such a wire straightening arrangement is favourable for handling ductile materials (such as A1, Cu, and Ag) tending to sag in response to a sudden increase in tensile stresses in the material of the wire between the dies 10, 11, 13, 14, whereby loops are formed on the wire 1, which are cut by the dies 10, 11, 13, 14 to break the wire 1. Therefore, extra self-feed of the wire 1 toward the convexities of the grooves 76 acts to prevent inadvertent sagging of the wire 1. Otherwise, the just described modification of the proposed wire straightening machine operates similarly to the machine described with reference to FIG. 1.

Figure 10:
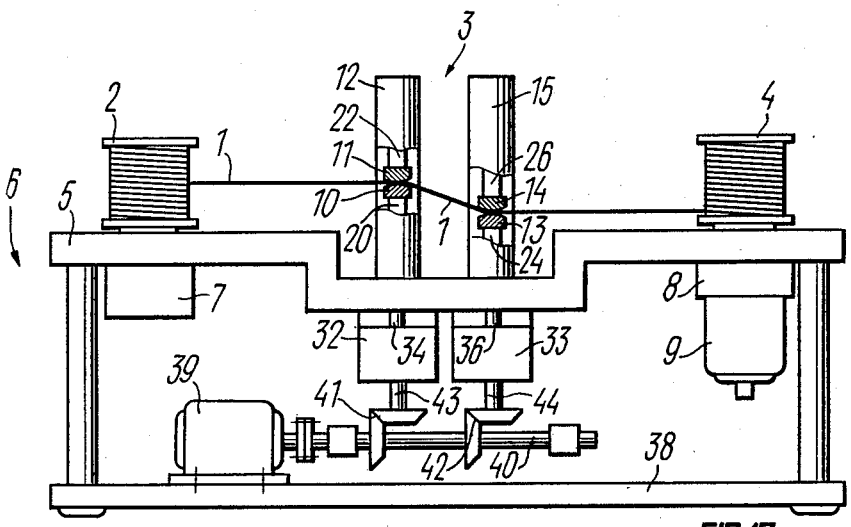
FIG. 10 is a general view of the wire straightening machine with reference to FIG. 1 in the case, when the dies of the wire twisting and stretching means disposed at one side of the wire lie in different parallel geometrical planes.
Figure 17:
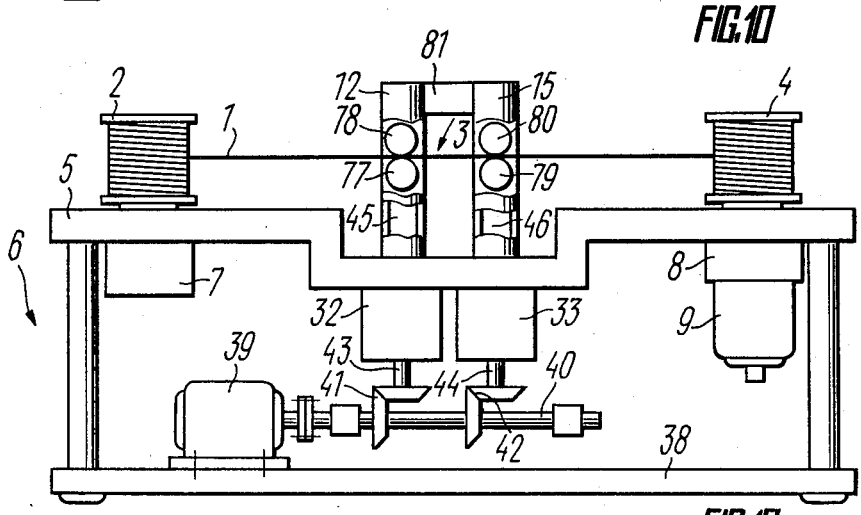
FIG. 17 is a general view of the wire straightening machine as illustrated in FIG. 1 in the case, when in the means for twisting and stretching the wire the straightening elements have the form of rolls.
Figure 18:
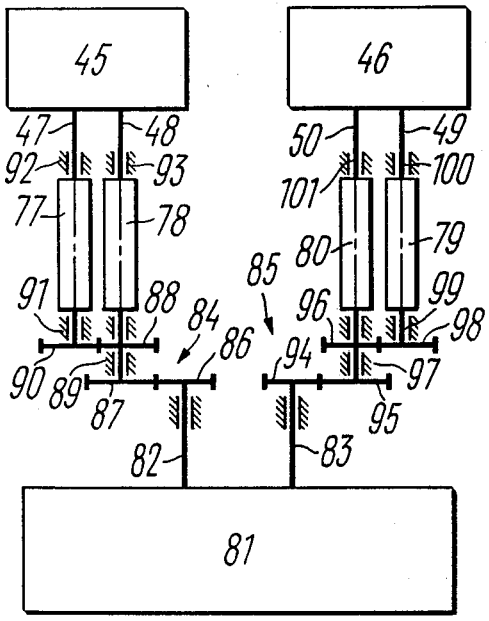
FIG. 18 is a kinematic diagram of the wire straightening machine represented in FIG. 17.
Figure 23:
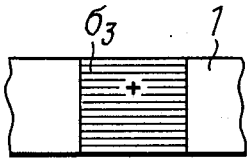
FIG. 23 is a diagram of tensile stresses of the material of the wire being straightened with reference to the wire straightening machine shown in FIG. 10.
Figure 19:
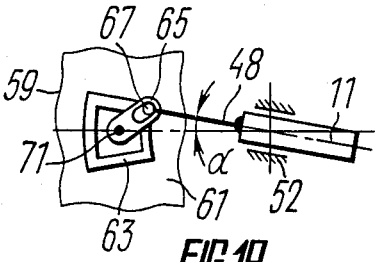
FIGS. 19, 20, 21 and 22 show kinematic diagrams of the mutual working positions of the die of the wire twisting and stretching means, and the pin of the reciprocating mechanism illustrated in FIG. 8.
Figure 20:
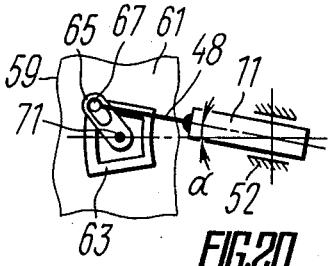
Figure 21:
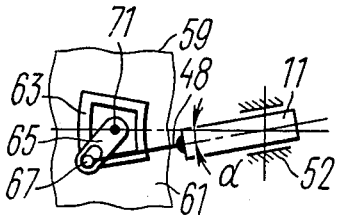
Figure 22:
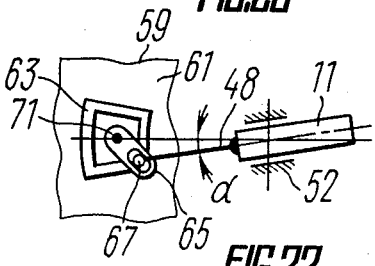

The modified form of the wire straightening machine illustrated in FIGS. 17 and 18 operates generally in the same manner as one shown in FIG. 1 or FIG. 10, the difference being in that the wire 1 is drawn or pulled through the rotating pairs of rolls 77, 78 and 79, 80 having a transmission ratio of 1:1 in each pair and 1:(1.0–1.4) between the pairs.

At the moment of starting the machine, along with the reciprocating mechanisms 45, 46, the rotating mechanism 81 is actuated to transmit rotation through the shafts 82, 83 and gear units 84, 85 to the rolls 77, 78 and 79, 80 so that the transmission ratio in each pair of rolls 77, 78 and 79, 80 would be 1:1, whereas the transmission ratio between the pairs of the rolls 77, 78 and 79, 80 would be 1:(1.0–1.4). The first pair of rolls 77, 78 pulls the wire 1 from the reel 2, and feeds it to the second pair of rolls 79, 80 acting to feed the wire 1 to the take up reel 4, thereby obviating the need for applying extra pull force on the wire and reducing the chance of wire breaking. In addition, such a transmission ratio between the pairs of rolls 77, 78 and 79, 80 ensures, due to the different speed of their rotation depending on the diameter of the wire 1 being straightened, optimized degree of elastic deformation of the wire 1 between the housing 12 and 15, and optimized degree of plastic deformation during twisting the wire 1 at the same wire length without changing the diameter of the wire 1.

What is claimed is:

1. A method of wire straightening comprising the steps in the following sequence:

twisting the wire in two opposite directions to plastic deformation of the material of the wire; and stretching the wire to within elastic deformation of the material of the wire simultaneously with said twisting step.

2. A method as defined in claim 1, further comprising the steps of:

simultaneously with twisting and stretching, bending of said wire about first and second bend angles of a bend surface, and first and second bend radii of said surface at said first angle and radius of bend of said bend surface greater than said second angle and radius of bend of said bend surface; and carrying out bending to attain plastic deformation of the material of said wire at said surface with said first bend radius.

3. A method as defined in claim 2, in which said wire is bent in two opposite directions on said first and second radii of said bend surface in one of said directions and third and fourth radii of said bend surface in a direction opposite to said direction, with said third radius of said bend surface being greater than said fourth bend radius of said bend surface.

4. A method as defined in claim 3, in which said wire is bent on said first and second bend anges of said bend surface in one of said directions, and on said third and fourth bend angles of said bend surface in a direction opposite to said direction at said first and second bend angles being equal therebetween, and said second and fourth bend angles being also equal therebetween.

5. A method as defined in claim 2, in which said wire is bent on said first and third bend radii of said bend surface equal therebetween, and on said second and fourth bend radii of said bend surface being equal therebetween.

6. A method as defined in claim 5, in which said wire is bent on said first and second bend angles in one of said directions, and on said third and fourth bend angles of said bend surface in a direction opposite to said direction at said first and third bend angles being equal therebetween, and said second and fourth bend angles being also equal therebetween.

7. A wire straightening machine coprising, arranged in the path of travel of the wire being straightened:

a means for reeling out the wire;

a means for twisting and stretching the wire including:

a first housing arranged in the path of travel of the wire after said means for reeling out the wire;

a first wire straightening element having a working surface and accommodated inside said housing;

a second wire straightening element having a working surface and accommodated inside said housing so that its working surface faces the said working surface of said first wire straightening element and is spaced therefrom at a distance determined by the diameter of said wire being straightened;

a first reciprocating mechanism accommodated inside said housing and mechanically connected to said first and second wire straightening elements;

a second housing arranged in sequence in the travel path of said wire after said first housing;

a third wire straightening element having a working surface and accommodated inside said second housing;

a fourth wire straightening element having a working surface and accommodated inside said second housing with its said working surface in front of said working surface of said third wire straightening element at a distance determined by the diameter of the wire being straightened;

a second reciprocating mechanism accommodated inside said second housing and mechanically connected to said third and fourth wire straightening elements;

a means for reeling on the wire arranged in succession after said second housing of said twisting and stretching means.

8. A machine as defined in claim 7, in which in said twisting and stretching means said first and second wire straightening elements are arranged in parallel with said second and fourth wire straightening elements, respectively.

9. A machine as defined in claim 8, in which said working surfaces of said first and third wire straightening elements disposed at one side of said wire being straightened, and those of said second and fourth wire straightening elements disposed at the other side of said wire being straightened are arranged in different geometrical planes.

10. A machine as defined in claim 9, in which said first, second, third and fourth wire straightening elements of said wire twisting and stretching means have the form of first, second, third and fourth dies, respectively, each of these dies having a longitudinal axis.

11. A machine as defined in claim 9, in which said first, second, third and fourth wire straightening elements of said wire twisting and stretching means have the form of first, second, third and fourth rolls, respectively, each of the rolls having a longitudinal axis and being capable of rotating about its own longitudinal axis in the path of travel of said wire, the machine per se additionally having a rotating mechanism mechanically connected to each of said rolls.

12. An apparatus as defined in claim 11, in which said first and third rolls are kinematically connected to said second and fourth rolls, respectively, with a transmission ratio of 1:1, whereas said first and second rolls, in combination, are kinematically connected to said third and fourth rolls, in combination, with a transmission ratio of 1:(1.0–1.4).

13. An apparatus as defined in claim 12, comprising:

a first gear unit having first and second shafts and mechanically connected by said first shaft to said rotating mechanism, and by said second shaft connected to said first and second rolls of said wire twisting and stretching means;

a second gear unit having first and second shafts and mechanically connected by said first shaft to said rotating mechanism, and connected by said second shaft to said third and fourth rolls of said wire twisting and stretching means.

14. A machine as defined in claim 8, in which said first, second, third and fourth wire straightening elements of said wire twisting and stretching means have the form of first, second, third and fourth dies, each having a longitudinal axis.

15. A machine as defined in claim 14, in which a curvilinear groove is provided in said working surface of each of said dies extending along said longitudinal axis thereof.

16. A machine as defined in claim 14, in which said reciprocating mechanism of said wire twisting and stretching means includes:

a cam having first and second end faces, and first and second grooves made in said first and second end faces, respectively;

a first slot link having a hole and disposed at the side of said first end face of said cam;

a second slot link having a hole and disposed at the side of said end face of said cam;

a first pin extending through said hole in said first slot link disposed in said first groove of said cam mechanically connected to said corresponding die of said wire twisting and stretching means;

a second pin extending through said hole in said second slot link disposed in said second groove of said cam and mechanically connected to said corresponding die of said wire twisting and stretching means.

17. A machine as defined in claim 8, in which said first, second, third and fourth wire straightening elements of said wire twisting and stretching means have the form of first, second, third and fourth rolls, respectively, each of the rolls having a longitudinal axis and being capable of rotating about its own respective longitudinal axis in the travel path of said wire, the machine per se additionally comprising a rotating mechanism mechanically connected to each of said rolls.

18. A machine as defined in claim 17, in which said first and third rolls are kinematically connected to said second and fourth rolls, respectively, with a transmission ratio of 1:1, whereas said first and second rolls, in combination, are kinematically connected to said third and fourth rolls, in combination, with a transmission ratio of 1:(1.0–1.4).

19. An apparatus as defined in claim 18, comprising:

a first gear unit having first and second shafts, and mechanically connected by said first shaft to said rotating mechanism, and connected by said second shaft to said first and second rolls of said wire twisting and stretching means;

a second gear unit having first and second shafts and mechanically connected by said first shaft to said rotating mechanism, and connected by said second shaft to said third and fourth rolls of said wire twisting and stretching means.

20. A machine as defined in claim 7, in which said first, second , third and fourth wire straightening elements of said means for twisting and stretching the wire have the form of first, second, third, and fourth dies, respectively, each such die having a longitudinal axis.

21. A machine as defined in claim 20, in which a curvilinear groove is provided in said working surface of each said die extending in the direction of its respective said longitudinal axis.

22. A machine as defined in claim 20, in which said reciprocating mechanism of said wire twisting and stretching means include:

a cam having first and second end faces, and first and second grooves in said first and second end faces, respectively;

a first slot link having a hole and arranged at the side of said first end face of said cam;

a second slot link having a hole and arranged at the side of said second end face of said cam;

a first pin extending through said hole in said first slot link and disposed in said first groove of said cam and mechanically connected to said corresponding die of said wire twisting and stretching means;

a second pin extending through said hole in said second slot link and disposed in said second groove of said cam and mechanically connected to said corresponding die of said wire twisting and stretching means.

23. A machine as defined in claim 7, in which said first, second, third and fourth wire straightening elements of said means for twisting and stretching the wire have the form of first, second, third and fourth rolls, respectively, each of these rolls having a longitudinal axis and being capable of rotating about its own longitudianl axis in the travel path of said wire, whereas the machine per se additionally comprises a rotating mechanism mechanically connected to each of said rolls.

24. A machine as defined in claim 23, in which said first and third rolls are kinematically interconnected to said second and fourth rolls, respectively, with a transmission ratio of 1:1, whereas said first and second rolls, in combination, are kinematically connected to said third and fourth rolls, in combination with a transmission ratio of 1:(1.0–1.4).

25. A machine as defined in claim 24, in which a curvilinear groove is provided in said working surface of each said die extending along said longitudinal axis thereof.

26. A machine as defined in claim 24, in which said reciprocating mechanism of said wire twisting and stretching means includes:

a cam having first and second end faces, and first and second grooves provided in said first and second end faces, respectively;

a first slot link having a hole and arranged at the side of said first end face of said cam;

a second slot link having a hole and arranged at the side of said second end face of said cam;

a first pin extending through said hole in said first slot link, disposed in said first groove of said cam, and mechanically connected to said corresponding die of said wire twisting and stretching means;

a second pin extending through said hole in said second slot link, disposed in said second groove of said cam, and mechanically connected to said corresponding die of said wire twisting and stretching means.

27. A machine as defined in claim 24 comprising:

a first gear unit having first and second shafts and mechanically connected by said first shaft to said rotating mechanism, and connected by said second shaft to said first and second rolls of said wire twisting and stretching means;

a second gear unit having first and second shafts and mechanically connected by said first shaft to said rotating mechanism, and connected by said second shaft to said third and fourth rolls of said wire twisting and stretching means.

* * * * *